US006812201B1

(12) United States Patent
Weuthen et al.

(10) Patent No.: US 6,812,201 B1
(45) Date of Patent: Nov. 2, 2004

(54) LOW-FOAMING, NONIONIC SURFACTANT MIXTURES, AND LAUNDRY DETERGENTS CONTAINING THE SAME

(75) Inventors: Manfred Weuthen, Langenfeld (DE); Karl Heinz Schmid, Mettmann (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 64 days.

(21) Appl. No.: 10/088,730

(22) PCT Filed: Sep. 13, 2000

(86) PCT No.: PCT/EP00/08922

§ 371 (c)(1),
(2), (4) Date: Mar. 22, 2002

(87) PCT Pub. No.: WO01/21743

PCT Pub. Date: Mar. 29, 2001

(30) Foreign Application Priority Data

Sep. 22, 1999 (DE) ..... 199 45 353

(51) Int. Cl.[7] ..... C11D 1/72; C11D 1/83; C11D 3/22; C11D 17/06

(52) U.S. Cl. ..... 510/446; 510/353; 510/356; 510/360; 510/413; 510/421; 510/470; 510/474; 510/475; 510/535

(58) Field of Search ..... 510/353, 356, 510/360, 413, 421, 446, 470, 474, 475, 535

(56) References Cited

U.S. PATENT DOCUMENTS 5,602,093 A * 2/1997 Haerer et al. ..... 510/514

* cited by examiner

*Primary Examiner*—Brian P. Mruk
(74) *Attorney, Agent, or Firm*—Aaron R. Ettelman

(57) ABSTRACT

Surfactant mixtures comprising (a) a nonionic surfactant mixture present in an amount greater than 60% by weight, based on the weight of the surfactant mixture, the nonionic surfactant mixture comprising: (i) at least one alk(en)yl oligoglycoside of the general formula (I), $$R^1O—[G]_p \quad (I)$$

wherein $R^1$ represents an alk(en)yl radical having from 4 to 22 carbon atoms, G represents a sugar radical having 5 or 6 carbon atoms and p represents a number from 1 to 10; and (ii) at least one nonionic surfactant of the general formula (II)

$$R^2O(CH_2CHRO)_xH \quad (II)$$

wherein x represents a number of from 1 to 30, each R independently represents a substituent selected from the group consisting of a hydrogen, a methyl group and an ethyl group, and $R^2$ represents a linear alkyl radical having from 16 to 22 carbon atoms; and (b) up to 6% by weight, based on the weight of the surfactant mixture, of one or more anionic surfactants; are described. Additional mixtures further comprising additional alcohol alkoxylates are also described. Solid laundry detergent compositions comprising such surfactant mixtures are described as well.

24 Claims, No Drawings

LOW-FOAMING, NONIONIC SURFACTANT MIXTURES, AND LAUNDRY DETERGENTS CONTAINING THE SAME

BACKGROUND OF THE INVENTION

Detergents for household laundry and industrial washing generally comprise anionic surfactants, nonionic surfactants, builders and numerous organic and inorganic additives. The anionic surfactants used for cleaning the laundry usually have a tendency toward foam development during the washing cycle, which firstly has a negative effect on the washing result and secondly can lead to the washing machine overflowing. There is therefore a practical need to control, and in particular to minimize, the development of foam during the washing operation. Antifoams are used for this purpose; these firstly are intended to reduce the development of foam and secondly to reduce foam which has already formed. The anionic surfactants, such as alkylbenzenesulfonates (also known in abbreviated form as ABS or LAS) or fatty alcohol sulfates (also known in abbreviated form as FAS) can be defoamed relatively readily and reliably using customary antifoams, for example those based on paraffins. Suitable paraffin wax mixtures as antifoams are described, for example, in European patent application EP 0309931 A1.

The defoaming or foam control in the case of surfactant mixtures with high contents of nonionic surfactants and in particular above all if the nonionic surfactants used are alkyl oligoglucosides based on linear fatty alcohols or branched oxo alcohols has proven more problematical. Such surfactant mixtures, which are characterized by particularly advantageous dissolution properties and are therefore of particular interest for the consumer, have hitherto only been reliably defoamed if silicones are used as antifoams, which are generally applied to carrier materials and optionally coated with other substances which have an antifoam action.

Thus, for example, European patent application EP 0496510 A1 discloses silicone-containing antifoams, a mixture of silicones and fatty alcohols, fatty acids or glycerol monoesters with specific melting points being applied to starch as carrier material. However, because of their sticky, oily consistency, silicones firstly have a tendency to stick together, as a result of which undesired silicone flecks may arise as residue on the washed laundry and, secondly, the silicones are relatively expensive antifoams.

Accordingly, there is a need for surfactant mixtures with high contents of nonionic surfactants which comprise alkyl oligoglycosides which can be defoamed more readily, it being possible to dispense with silicones and antifoams at least partially, preferably completely.

The object of the present invention was accordingly to provide surfactant mixtures for the preparation of solid detergents with high contents of nonionic surfactants which, despite the alkyl oligoglycosides present, are foam-controlled even with small amounts of antifoams. Furthermore, it was the intention for good foam control to be possible as far as possible with small amounts or even without silicones and antifoams. The surfactants or the, solid laundry detergents based thereon should of course satisfy the requirements for laundry detergents with regard to primary detergency.

BRIEF SUMMARY OF THE INVENTION

The present invention relates, in general, to surfactant mixtures for the preparation of solid, foam-controlled laundry detergents, and more particularly, to surfactant mixtures with high contents of specifically selected nonionic surfactants and no or only low contents of anionic surfactants. Further subject-matter of the present invention relates to solid foam-controlled laundry detergents comprising such surfactant mixtures, and the use of such surfactant mixtures for the preparation of solid, foam-controlled detergents.

One subject-matter of the present invention thus relates to surfactant mixtures for the preparation of solid laundry detergents, comprising A) anionic surfactants in amounts of from 0 to 6% by weight and B) a nonionic surfactant mixture in amounts greater than 60% by weight—in each case based on the total surfactant mixture—, where the nonionic surfactant mixture comprises a) at least one alkyl and/or alkenyl oligoglycoside of the formula (I), $$R^1O—[G]_p \quad (I)$$

in which $R^1$ is a linear and/or branched alkyl and/or alkenyl radical having 4 to 22 carbon atoms, G is a sugar radical having 5 or 6 carbon atoms and p is a number from 1 to 10, and b) at least one nonionic surfactant of the formula (II)

$$R^2O(CH_2CHRO)_xH \quad (II)$$

in which x is a number from 1 to 30, R is hydrogen, methyl and/or ethyl and $R^2$ is alkyl radicals derived from an alcohol mixture of: 80 to 100% by weight of linear saturated and/or unsaturated alcohols having 16 to 22 carbon atoms and 0 to 20% by weight of linear saturated and/or unsaturated alcohols having 6 to 14 carbon atoms, and optionally c) at least one further nonionic surfactant chosen from the group formed by c1) alcohol ethoxylates of the formula (III)

$$R^3O(CH_2CHRO)_yH \quad (III)$$

in which y is a number from 1 to 30, R is hydrogen, methyl and/or ethyl and $R^3$ is alkyl radicals derived from an alcohol mixture of: 70 to 95% by weight of linear saturated and/or unsaturated alcohols having 8 to 22 carbon atoms and 5 to 30% by weight of saturated and/or unsaturated alcohols having 8 to 22 carbon atoms and branched with methyl groups, and 0 to 10% by weight of saturated and/or unsaturated alcohols having 8 to 22 carbon atoms and branched with alkyl groups having at least 2 carbon atoms c2) alcohol ethoxylates of the formula (IV)

$$R^4O(CH_2CHRO)_xH \quad (IV)$$

in which z is a number from 1 to 30, R is hydrogen, methyl and/or ethyl and $R^4$ is alkyl radicals derived from an alcohol mixture of: 35 to 55% by weight of linear saturated and/or unsaturated alcohols having 8 to 22 carbon atoms and 10 to 20% by weight of saturated and/or unsaturated alcohols having 8 to 22 carbon atoms and branched with methyl groups, and 35 to 45% by weight of saturated and/or unsaturated alcohols having 8 to 22 carbon atoms and branched with alkyl groups having at least 2 carbon atoms c3) alcohol ethoxylates of the formula (V)

$$R^5O(CH_2CHRO)_qH \quad (V)$$

in which q is a number from 1 to 30, R is hydrogen, methyl and/or ethyl and $R^5$ is alkyl radicals derived from an alcohol mixture of: 0 to 10% by weight of linear saturated and/or unsaturated alcohols having 6 to 10 carbon atoms and 40 to 90% by weight of linear saturated and/or unsaturated alcohols having 12 to 14 carbon atoms and 0 to 30% by weight of linear saturated and/or unsaturated alcohols having 16 to 22 carbon atoms c4) fatty acid polyglycol esters of the formula (VI)

$$R^6COO(CH_2CHRO)_sR^7 \quad (VI)$$

in which s is a number from 1 to 30, $R^6CO$ is linear or branched saturated or unsaturated acyl radicals having 6 to 22 carbon atoms, $R^7$ is linear or branched alkyl radicals having 1 to 4 carbon atoms and R is hydrogen, methyl and/or ethyl.

A further subject-matter of the present invention relates to solid foam-controlled laundry detergents comprising, in amounts of from 5 to 30% by weight, a surfactant mixture comprising A) anionic surfactants in amounts of from 0 to 6% by weight and B) a nonionic surfactant mixture in amounts greater than 60% by weight—in each case based on the total surfactant mixture—, where the nonionic surfactant mixture comprises a) at least one alkyl and/or alkenyl oligoglycoside of the formula (I), $$R^1O—[G]_p \quad (I)$$

in which $R^1$ is a linear and/or branched alkyl and/or alkenyl radical having 4 to 22 carbon atoms, G is a sugar radical having 5 or 6 carbon atoms and p is a number from 1 to 10, and b) at least one nonionic surfactant of the formula (II)

$$R^2O(CH_2CHRO)_xH \quad (II)$$

in which x is a number from 1 to 30, R is hydrogen, methyl and/or ethyl and $R^2$ is alkyl radicals derived from an alcohol mixture of: 80 to 100% by weight of linear saturated and/or unsaturated alcohols having 16 to 22 carbon atoms and 0 to 20% by weight of linear saturated and/or unsaturated alcohols having 6 to 14 carbon atoms, and optionally c) at least one further nonionic surfactant chosen from the group formed by c1) alcohol ethoxylates of the formula (III)

$$R^3O(CH_2CHRO)_yH \quad (III)$$

in which y is a number from 1 to 30, R is hydrogen, methyl and/or ethyl and $R^3$ is alkyl radicals derived from an alcohol mixture of: 70 to 95% by weight of linear saturated and/or unsaturated alcohols having 8 to 22 carbon atoms and 5 to 30% by weight of saturated and/or unsaturated alcohols having 8 to 22 carbon atoms and branched with methyl groups, and 0 to 10% by weight of saturated and/or unsaturated alcohols having 8 to 22 carbon atoms and branched with alkyl groups having at least 2 carbon atoms c2) alcohol ethoxylates of the formula (IV)

$$R^4O(CH_2CHRO)_zH \quad (IV)$$

in which z is a number from 1 to 30, R is hydrogen, methyl and/or ethyl and $R^4$ is alkyl radicals derived from an alcohol mixture of: 35 to 55% by weight of linear saturated and/or unsaturated alcohols having 8 to 22 carbon atoms and 10 to 20% by weight of saturated and/or unsaturated alcohols having 8 to 22 carbon atoms and branched with methyl groups, and 35 to 45% by weight of saturated and/or unsaturated alcohols having 8 to 22 carbon atoms and branched with alkyl groups having at least 2 carbon atoms c3) alcohol ethoxylates of the formula (V)

$$R^5O(CH_2CHRO)_qH \quad (V)$$

in which q is a number from 1 to 30, R is hydrogen, methyl and/or ethyl and $R^5$ is alkyl radicals derived from an alcohol mixture of: 0 to 10% by weight of linear saturated and/or unsaturated alcohols having 6 to 10 carbon atoms and 40 to 90% by weight of linear saturated and/or unsaturated alcohols having 12 to 14 carbon atoms and 0 to 30% by weight of linear saturated and/or unsaturated alcohols having 16 to 22 carbon atoms c4) fatty acid polyglycol esters of the formula (VI)

$$R^6COO(CH_2CHRO)_sR^7 \quad (VI)$$

in which s is a number from 1 to 30, $R^6CO$ is linear or branched saturated or unsaturated acyl radicals having 6 to 22 carbon atoms, $R^7$ is linear or branched alkyl radicals having 1 to 4 carbon atoms and R is hydrogen, methyl and/or ethyl.

The present application further relates to the use of the surfactant mixture of the type described for the preparation of solid, foam-controlled laundry detergents.

Surprisingly, it has been found that a very good foam control, especially of the difficult-to-defoam alkyl glycosides, is achieved in the presence of nonionic surfactants of the formula (II), which in simplified terms are alkoxylates of long-chain alcohols having 16 to 18 carbon atoms. Particularly good results are achieved with regard to detergency and foam control if further nonionic surfactants are additionally used, such as shorter-chain alcohol alkoxylates and branched alcohol alkoxylates and/or fatty acid polyglycol esters.

DETAILED DESCRIPTION OF THE INVENTION

Surfactant Mixture

For the purposes of the present invention, nonionic surfactants are obligatorily present in the surfactant mixture according to the invention in amounts greater than 60% by weight to 100% by weight, preferably in amounts of from 70 to 98.5% by weight—based on the total surfactant content. The surfactants which make the total up to 100% by weight may firstly be anionic surfactants, which are present in amounts of from 0 to 6% by weight, preferably in amounts of from 0 to 3% by weight, in particular in amounts of from 0 to 1.5% by weight.

Typical examples of anionic surfactants are soaps, alkylbenzenesulfonates, alkanesulfonates, olefinsulfonates, alkyl ether sulfonates, glycerol ether sulfonates, α-methyl ester sulfonates, sulfofatty acids, alkyl sulfates, fatty alcohol ether sulfates, glycerol ether sulfates, fatty acid ether sulfates, hydroxy mixed ether sulfates, monoglyceride (ether) sulfates, fatty acid amide(ether)sulfates, mono- and dialkyl sulfosuccinates, mono- and dialkyl sulfosuccinamates, sulfotriglycerides, amide soaps, ether carboxylic acids and salts thereof, fatty acid isothionates, fatty acid sarcosinates, fatty acid taurides, N-acylamino acids, such as, for example, acyl lactylates, acyl tartrates, acyl glutamates and acyl aspartates, alkyl oligoglucoside sulfates, protein fatty acid condensates (in particular vegetable products based on wheat) and alkyl(ether)phosphates. If the anionic surfactants comprise polyglycol ether chains, these can have a conventional, but preferably a narrowed, homolog distribution.

Advantageously, no anionic surfactants are added to the surfactant mixture. However, impurities of anionic surfactants, entrained by the other constituents in minor amounts, may be present in the surfactant mixture or the solid laundry detergent.

Further optional surfactants which may be present in the surfactant mixture are cationic, zwitterionic or ampholytic surfactants ad 100% by weight—based on surfactant mixture. Typical examples of cationic surfactants are quaternary ammonium compounds, such as, for example, dimethyldistearylammonium chloride, and ester quats, in particular quaternized fatty acid trialkanolamine ester salts. Typical examples of amphoteric or zwitterionic surfactants are alkylbetaines, alkylamidobetaines, aminopropionates, aminoglycinates, imidazoliniumbetaines and sulfobetaines. Said surfactants are all known compounds. With regard to structure and preparation of these substances, reference is made to the relevant review works, for example J. Falbe (ed.), "Surfactants in Consumer Products", Springer Verlag, Berlin, 1987, pp. 54–124 or J. Falbe (ed.), "Katalysatoren, Tenside und Mineralöladditive", Thieme Verlag, Stuttgart, 1978, pp. 123–217.

Nonionic Surfactant Mixture

For the purposes of the present invention, the nonionic surfactants of the formula (I) and (II) are obligatorily present in the surfactant mixture according to the invention. Further nonionic surfactants are also preferably present, at least one nonionic surfactant of the formulae (III) to (VI) preferably also being present. Moreover, the nonionic surfactant mixture can comprise further customary nonionic surfactants as required, for example alkylphenol polyglycol ether, fatty acid amide polyglycol ether, fatty amine polyglycol ether, alkoxylated triglycerides, mixed ethers and mixed formals, partially oxidized alk(en)yl oligoglycosides and glucoronic acid derivatives, fatty acid N-alkylglucamides, protein hydrolyzates (in particular vegetable products based on wheat), polyol fatty acid esters, sugar esters, sorbitan esters, polysorbates and amine oxides. If the nonionic surfactants contain polyglycol ether chains, these may have a conventional or else a narrowed homolog distribution. The further customary nonionic surfactants are preferably present in minor amounts, usually up to at most 40% by weight, preferably up to at most 20% by weight and in particular in amounts of from 0 to 10% by weight—based on nonionic surfactant mixture.

According to one embodiment of the present invention, the nonionic surfactant mixture consists exclusively of the nonionic surfactants of the formula (I) and (II).

The nonionic surfactants of the formula (I) are alkyl and/or alkenyl oligoglycosides. These represent known nonionic surfactants, which can be obtained by the relevant methods of preparative organic chemistry. By way of a representative for the extensive literature, reference is made to the review work by Biermann et al. in Starch 45, 281 (1993), B. Salka in Cosm. Toil. 108, 89 (1993) and J. Kahre et al. in SÖFW-Journal Volume 8, 598 (1995).

The alkyl and/or alkenyl oligoglycosides can be derived from aldoses or ketoses having 5 or 6 carbon atoms, preferably from glucose. The preferred alkyl and/or alkenyl oligoglycosides are thus alkyl and/or alkenyl oligoglucosides. The index number p in the general formula (I) gives the degree of oligomerization (DP), i.e. the distribution of monoglycosides and oligoglycosides and is a number between 1 and 10. While p must always be an integer in a given compound and here can primarily assume the values p=1 to 6, the value p for a certain alkyl oligoglycoside is an analytically determined calculated parameter which in most cases is a fraction. Preference is given to using alkyl and/or alkenyl oligoglycosides with an average degree of oligomerization p of from 1.1 to 3.0. From an applications view point, preference is given to those alkyl and/or alkenyl oligoglycosides whose degree of oligomerization is less than 1.7 and is in particular between 1.2 and 1.4. The alkyl or alkenyl radical $R^1$ can be derived from primary alcohols having 4 to 11, preferably 8 to 10 carbon atoms. Typical examples are butanol, caproic alcohol, caprylic alcohol, capric alcohol and undecyl alcohol, and technical-grade mixtures thereof as are obtained, for example, in the hydrogenation of technical-grade fatty acid methyl esters or in the course of the hydrogenation of aldehydes from the Roelen oxo synthesis. Preference is given to alkyl oligoglucosides of chain length $C_8$–$C_{10}$ (DP=1 to 3) which form as forerunnings in the distillative separation of technical-grade $C_8$–$C_{18}$-coconut fatty alcohol and can be contaminated with a proportion of less than 6% by weight of $C_{12}$-alcohol, and alkyl oligoglucosides based on technical-grade $C_{9/11}$-oxo alcohols (DP=1 to 3). The alkyl or alkenyl radical $R^1$ can also be derived from primary alcohols having 12 to 22, preferably 12 to 14, carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol, and technical-grade mixtures thereof, which can be obtained as described above. Preference is given to alkyl oligoglucosides based on hydrogenated $C_{12/14}$-coconut alcohol or branched $C_{11/15}$-oxo alcohols with a DP of from 1 to 3.

The nonionic surfactants of the formula (II) are alkoxylates of mixtures of linear alcohols which comprise 70 to 100% by weight, preferably 80 to 100% by weight, of alcohols with 16 to 22 carbon atoms, preferably 16 to 18 carbon atoms, and 0 to 30% by weight, preferably 0 to 20% by weight, of linear alcohols having 6 to 14 carbon atoms. Particularly suitable alcohol mixtures on which the nonionic surfactants of the formula (II) are based consist of

- 0 to 5% by weight, in particular 0 to 2% by weight, of linear saturated alcohols having 12 carbon atoms;
- 0 to 10% by weight, preferably 3 to 8% by weight, of linear saturated alcohols having 14 carbon atoms,
- 20 to 50% by weight, preferably 25 to 35% by weight, of linear saturated alcohols having 16 carbon atoms;
- 50 to 80% by weight, preferably 60 to 70% by weight, of linear saturated alcohols having 18 carbon atoms and
- 0 to 5% by weight, preferably 0 to 2% by weight, of linear saturated alcohols having 22 carbon atoms.

Such alcohol mixtures can be obtained from tallow, palm kernel oil or by reduction of aldehydes from the Roelen oxo synthesis.

The alcohol mixtures described have ethylene oxide, propylene oxide and/or butylene oxide, preferably ethylene oxide and/or propylene oxide, added as block polymers and/or random polymers. If ethylene oxide and propylene oxide are added, the number of added moles of propylene oxide is preferably in the range from 0.5 to 5 mol, and the number of added moles of ethylene oxide is preferably in the range from 0.5 to 25 mol, in particular in the range from 7 to 25 mol, of ethylene oxide. A typical example thereof are block copolymers with 1 mol of propylene oxide and 22 mol of ethylene oxide.

Alcohol ethoxylates of the formula (II) which have 4 to 12, preferably 5 to 10, mol of ethylene oxide (x) added on average are particularly suitable.

According to a further embodiment of the present invention, the nonionic surfactant mixtures comprise, in addition to the alkyl polyglycosides of the formula (I) and the alcohol alkoxylates of the formula (II), additionally at least one of the nonionic surfactants of the formula (III), (IV), (V) and/or (VI).

The nonionic surfactants of the formula (III) (component c1) are alcohol alkoxylates derived from alcohols with a low degree of branching. Such alcohols with a low degree of branching are a alcohol mixture of

- 70 to 95% by weight of linear saturated and/or unsaturated alcohols having 8 to 22 carbon atoms and
- 5 to 30% by weight of saturated and/or unsaturated alcohols having 8 to 22 carbon atoms and branched with methyl groups and
- 0 to 10% by weight of saturated and/or unsaturated alcohols having 8 to 22 carbon atoms and branched with alkyl groups having at least 2 carbon atoms, preferably of
- 73 to 85% by weight of linear saturated and/or unsaturated alcohols having 8 to 22 carbon atoms and
- 13 to 25% by weight of saturated and/or unsaturated alcohols having 8 to 22 carbon atoms and branched with methyl groups and
- 2 to 7% by weight of saturated and/or unsaturated alcohols having 8 to 22 carbon atoms and branched with alkyl groups having at least 2 carbon atoms.

Of these, particularly suitable alcohol mixtures are those in which the proportion of the methyl-branched alcohols constitutes at least 80% by weight, preferably at least 90% by weight, of the total branched alcohols present. Such alcohol mixtures are obtainable by a special oxo synthesis known from the prior art by reacting carbon monoxide and hydrogen over α-position olefins according to the SHOP. Such alcohol mixtures are available commercially under the trade name Dobanol® and Neodol®. Suitable alcohol mixtures are Dobanol 91®, 23®, 25®, 45® and Neodol 91®, 1®, 23®, 25®, 45®.

Particularly suitable alcohol mixtures of the type described are those derived from alcohols having a total of 12 to 15 carbon atoms, the carbon atoms in the branches being included in the total number of carbons. In other words, $R^3$ in formula (III) is in particular alkyl radicals of an alcohol mixture of

- 73 to 85% by weight of linear saturated and/or unsaturated alcohols having 12 to 15 carbon atoms and
- 13 to 25% by weight of saturated and/or unsaturated alcohols having 12 to 15 carbon atoms and branched with methyl groups and
- 2 to 7% by weight of saturated and/or unsaturated alcohols having 10 to 15 carbon atoms and branched with alkyl groups having at least 2 carbon atoms.

The alcohol mixtures described have ethylene oxide, propylene oxide and/or butylene oxide, preferably ethylene oxide and/or propylene oxide, added as block polymers and/or random polymers. If ethylene oxide and propylene oxide are added, the number of added moles of propylene oxide is preferably in the range from 0.5 to 5 mol and the number of added moles of ethylene oxide is preferably in the range from 0.5 to 25 mol, in particular in the range from 7 to 25 mol of ethylene oxide. A typical example thereof are block copolymers with 1 mol of propylene oxide and 22 mol of ethylene oxide.

Ethylene oxide adducts of such alcohol mixtures are particularly suitable, where the number of added moles of ethylene oxide is in the range from 1 to 20, preferably from 4 to 12 and particularly preferably from 5 to 10, where it will be clear to the person skilled in the art that this is a statistical number.

The alcohol alkoxylates of the formula (IV) (component c2) are alkoxylates of heavily branched alcohol mixtures, as are obtained by the classical oxo process from Eni or from Condea by the addition of carbon monoxide and hydrogen onto olefins which do not exclusively carry terminal double bonds. These heavily branched alcohol mixtures are a mixture of alcohols of

- 35 to 5.5% by weight of linear saturated and/or unsaturated alcohols having 8 to 22 carbon atoms and
- 10 to 20% by weight of saturated and/or unsaturated alcohols having 8 to 22 carbon atoms and branched with methyl groups and
- 35 to 45% by weight of saturated and/or unsaturated alcohols having 8 to 22 carbon atoms and branched with alkyl groups having at least 2 carbon atoms.

Particularly suitable alcohol mixtures are those which form the basis of the alkoxylates of the formula (IV) in which the proportion of branched alcohols—based on alcohol mixture—is overall in the range from 50 to 60% by weight, and the proportion of linear alcohols is in the range from 40 to 50% by weight.

Such alcohol mixtures are available commercially under the trade name Lial®. Suitable alcohol mixtures are the grades Lial 91®, Lial 111®, Lial 123®, Lial 125®, Lial 145®.

The alcohol mixtures described have ethylene oxide, propylene oxide and/or butylene oxide, preferably ethylene oxide and/or propylene oxide, added as block polymers and/or random polymers. If ethylene oxide and propylene oxide are added, the number of added moles of propylene oxide is preferably in the range from 0.5 to 5 mol and the number of added moles of ethylene oxide is preferably in the range from 0.5 to 25 mol, in particular in the range from 7 to 25 mol of ethylene oxide. A typical example thereof are block copolymers with 1 mol of propylene oxide and 22 mol of ethylene oxide.

Ethylene oxide adducts of such alcohol mixtures are particularly suitable, where the number of added moles of ethylene oxide is in the range from 1 to 20, preferably from 4 to 12 and particularly preferably from 5 to 10, where it will be clear to the person skilled in the art that this is a statistical number.

The nonionic surfactants of the formula (V) (component c3) are alkoxylates of an alcohol mixture of shorter-chain fatty alcohols of

- 0 to 10% by weight, preferably 0 to 5% by weight, of linear saturated and/or unsaturated alcohols having 6 to 10 carbon atoms
- 40 to 90% by weight, preferably 55 to 85% by weight, of linear saturated and/or unsaturated alcohols having 12 to 14 carbon atoms and 0 to 30% by weight, preferably 10 to 25% by weight, of linear saturated and/or unsaturated alcohols having 16 to 22 carbon atoms.

Such alcohol mixtures are obtainable as cuts, for example from coconut oil or by reducing aldehydes from the Roelen oxo synthesis.

The alcohol mixtures described have ethylene oxide, propylene oxide and/or butylene oxide, preferably ethylene oxide and/or propylene oxide, added as block polymers and/or random polymers. If ethylene oxide and propylene oxide are added, the number of added moles of propylene oxide is preferably in the range from 0.5 to 5 mol and the number of added moles of ethylene oxide is preferably in the range from 0.5 to 25 mol, in particular in the range from 7 to 25 mol of ethylene oxide. A typical example thereof are block copolymers with 1 mol of propylene oxide and 22 mol of ethylene oxide.

Ethylene oxide adducts of such alcohol mixtures are particularly suitable, where the number of added moles of ethylene oxide is in the range from 1 to 20, preferably from 4 to 12 and particularly preferably from 5 to 10, where it will be clear to the person skilled in the art that this is a statistical number.

For the purposes of the invention, it has proven particularly advantageous if the nonionic surfactants of the formula (II) and (III) to (V) have the same (statistical) degree of ethoxylation, i.e. x and y or z or q is the same number.

The nonionic surfactants of the formula (VI) (component c4) are preferably addition products of, on average, 1 to 30 mol of ethylene oxide and/or propylene oxide onto linear or branched, saturated and/or unsaturated fatty acids, such as, for example, caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselic acid, linoleic acid, linolenic acid, elaeostearic acid, arachidic acid, gadoleic acid, behenic acid and erucic acid, and technical-grade mixtures thereof which are produced, for example, during the pressurized cleavage of natural fats and oils, during the reduction of aldehydes from Roelen oxo synthesis or the dimerization of unsaturated fatty acids. Antifoams which have proven particularly effective are nonionic surfactants of the formula (VI) in which $R^6CO$ is an acyl radical having 16 to 18 carbon atoms, $R^7$ is a methyl group, R is hydrogen and s is a number from 10 to 15. The most suitable alkoxylated fatty acid esters are those which combine these four structural features. The alkoxylated fatty acid alkyl esters can be prepared in a known manner, preferably by alkoxylation of the fatty acid alkyl esters in the presence of calcined hydrotalcite.

It has proven advantageous to use the alkyl polyglycosides of the formula (I) (component a) in a weight ratio to the nonionic surfactants of the formula (II) (component b) of from 20:1 to 1:20, preferably from 10:1 to 1:5 and in particular from 10:1 to 1:2. If a further nonionic surfactant as component c) chosen from components c1) to c4) is also present, it has proven advantageous if the weight ratio of the alkyl glycosides (component a) to the nonionic surfactants (components b+c) is in the range from 10:1 to 1:20, preferably 5:1 to 1:10 and in particular 2:1 to 1:5. The ratio of the nonionic surfactants of the formula (II) (component b) to those of the formulae (III) to (VI) (component c) is largely unimportant and is advantageously in the range from 1:20 to 20:1, preferably in the range from 1:10 to 1:1 and in particular in the range from 1:8 to 1:1.5.

Laundry Detergents

The surfactant mixtures according to the invention are present in the solid laundry detergents in amounts of from 5 to 30% by weight, preferably in amounts of from 10 to 25% by weight and in particular in amounts of from 15 to 25% by weight—based on detergent. The surfactant mixtures according to the invention are already foam-reduced per se relative to detergents comprising only alkyl polyglycosides, but in order to ensure good foam control, the addition of further antifoams is recommended.

The laundry detergents according to the invention comprise the antifoams—calculated as active substance content and based on detergent—preferably in total amounts of from 0.05 to 5% by weight, preferably from 0.1 to 3% by weight and in particular from 0.5 to 2% by weight. According to one embodiment of the present invention, exclusively wax-like antifoam compounds are present as antifoams. "Wax-like" compounds are to be understood as meaning those compounds which have a melting point at atmospheric pressure above 25° C. (room temperature), preferably above 50° C. and in particular above 70° C. The wax-like antifoam substances which are optionally present according to the invention are virtually insoluble in water, i.e. at 20° C. they have a solubility in 100 g of water of less than 0.1% by weight. In principle, all wax-like antifoam substances known from the prior art may be present. Suitable wax-like compounds are, for example, bisamides, fatty alcohols, fatty acids, carboxylic esters of mono- and polyhydric alcohols, and paraffin waxes or mixtures thereof. In addition, it is of course also possible to use the silicone compounds known for this purpose.

Suitable paraffin waxes are generally a complex mixture of substances without a sharp melting point. For characterization, its melting range is usually determined by differential thermoanalysis (DTA), as described in "The Analyst" 87 (1962), 420, and/or its solidification point. This is understood as being the temperature at which the paraffin converts from the liquid state to the solid state as a result of slow cooling. In this connection, paraffins which are completely liquid at room temperature, i.e. those with a solidification point below 25° C., cannot be used according to the invention. It is possible, for example, to use the paraffin wax mixtures, known from EP 0309931 A1, of, for example, 26% by weight to 49% by weight of microcrystalline paraffin wax with a solidification point of from 62° C. to 90° C., 20% by weight to 49% by weight of hard paraffin with a solidification point of from 42° C. to 56° C. and 2% by weight to 25% by weight of soft paraffin with a solidification point of from 35° C. to 40° C. Preference is given to using paraffins or paraffin mixtures which solidify in the range from 30° C. to 90° C. In this connection, it must be taken into consideration that paraffin wax mixtures which appear solid at room temperature may also comprise varying amounts of liquid paraffin. In the paraffin waxes which can be used according to the invention this liquid content is as small as possible and is preferably not present at all. Thus, particularly preferred paraffin wax mixtures have a liquid content of less 10% by weight, in particular of from 2% by weight to 5% by weight, at 30° C., a liquid content of less than 30% by weight, preferably of from 5% by weight to 25% by weight and in particular from 5% by weight to 15% by weight at 40° C., a liquid content of from 30% by weight to 60% by weight, in particular from 40% by weight to 55% by weight, at 60° C., a liquid content of from 80% by weight to 100% by weight at 80° C., and a liquid content of 100% by weight at 90° C. The temperature at which a liquid content of 100% by weight of the paraffin wax is achieved is, in the case of particularly preferred paraffin wax mixtures, still less than 85° C., in particular 75° C. to 82° C. The paraffin waxes may be petrolatum, microcrystalline waxes or hydrogenated or partially hydrogenated paraffin waxes.

Suitable bisamides as antifoams are those derived from saturated fatty acids having 12 to 22, preferably 14 to 18, carbon atoms, and from alkylenediamines having 2 to 7 carbon atoms. Suitable fatty acids are lauric acid, myristic acid, stearic acid, arachidic acid and behenic acid, and mixtures thereof, as are obtainable from natural fats or hydrogenated oils, such as tallow or hydrogenated palm oil. Suitable diamines are, for example, ethylenediamine, 1,3-propylenediamine, tetramethylenediamine, pentamethylenediamine, hexamethylenediamine, p-phenylenediamine and tolylenediamine. Preferred diamines are ethylenediamine and hexamethylenediamine. Particularly preferred bisamides are bismyristoylethylenediamine, bispalmitoylethylenediamine, bisstearoylethylenediamine and mixtures thereof, and the corresponding derivatives of hexamethylenediamine.

Suitable carboxylic esters as antifoams are derived from carboxylic acids having 12 to 28 carbon atoms. In particular, these are esters of behenic acid, stearic acid, hydroxystearic acid, oleic acid, palmitic acid, myristic acid and/or lauric acid. The alcohol moiety of the carboxylic ester contains a mono- or polyhydric alcohol having 1 to 28 carbon atoms in the hydrocarbon chain. Examples of suitable alcohols are behenyl alcohol, arachidyl alcohol, coconut alcohol, 12-hydroxystearyl alcohol, oleyl alcohol and lauryl alcohol, and also ethylene glycol, glycerol, polyvinyl alcohol, sucrose, erythritol, pentaerythritol, sorbitan and/or sorbitol. Preferred esters are those of ethylene glycol, glycerol and sorbitan, where the acid moiety of the ester is chosen in particular from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate and sorbitan monostearate, sorbitan palmitate, sorbitan monolaurate, sorbitan dilaurate, sorbitan distearate, sorbitan dibehenate, sorbitan dioleate, and mixed tallow alkylsorbitan mono- and diesters. Glycerol esters which can be used are the mono-, di- or triesters of glycerol and said carboxylic acids, preference being given to the mono- or diesters. Glycerol monostearate, glycerol monooleate, glycerol monopalmitate, glycerol monobehenate and glycerol distearate are examples thereof. Examples of suitable natural esters as antifoams are beeswax, which consists mainly of the esters $CH_3(CH_2)_{24}COO(CH_2)_{27}CH_3$ and $CH_3(CH_2)_{26}COO(CH_2)_{25}CH_3$, and carnauba wax, which is a mixture of carnaubic acid alkyl esters, often in combination with small amounts of free carnaubic acid, further long-chain acids, high molecular weight alcohols and hydrocarbons.

Suitable carboxylic acids as further antifoam compound are, in particular, behenic acid, stearic acid, oleic acid, palmitic acid, myristic acid and lauric acid, and mixtures thereof, as are obtainable from natural fats or optionally hydrogenated oils, such as tallow or hydrogenated palm oil. Preference is given to saturated fatty acids having 12 to 22, in particular 18 to 22, carbon atoms.

Suitable fatty alcohols as further antifoam compound are the hydrogenated products of the fatty acids described.

In addition, dialkyl ethers may additionally be present as antifoams. The ethers may have an asymmetric or else a symmetric structure, i.e. contain two identical or different alkyl chains, preferably having 8 to 18 carbon atoms. Typical examples are di-n-octyl ether, di-i-octyl ether and di-n-stearyl ether, and dialkyl ethers which have a melting point greater than 25° C., in particular greater than 40° C., are particularly suitable.

Further suitable antifoam compounds are fatty ketones of the formula (VII), $$R^9—CO—R^{10} \quad \text{(VII)}$$

in which $R^9$ and $R^{10}$, independently of one another, are linear or branched hydrocarbon radicals having 11 to 25 carbon atoms and 0 or 1 double bond. Such ketones are known substances which can be obtained by the relevant methods of preparative organic chemistry. They are prepared, for example, starting from carboxylic acid magnesium salts, which are pyrrolyzed at temperatures above 300° C. with the elimination of carbon dioxide and water, for example in accordance with German laid-open specification DE 2553900 A. Suitable fatty ketones are those prepared by pyrrolysis of the magnesium salts of lauric acid, myristic acid, palmitic acid, palmitoleic acid, stearic acid, oleic acid, elaidic acid, petroselic acid, arachidic acid, gadoleic acid, behenic acid or erucic acid. Preference is given to 16-hentriacontanone; ($R^9$ and R are an alkyl radical having 15 carbon atoms), 17-tritriacontanone ($R^9$ and $R^{10}$ is an alkyl radical having 16 carbon atoms), stearone (18-pentatriacontanone; $R^9$ and $R^{10}$ is an alkyl radical having 17 carbon atoms), 19-heptatricontanone ($R^9$ and $R^{10}$ is an alkyl radical having 18 carbon atoms), arachinone (20-nonatriacontanone; $R^9$ and $R^{10}$ is an alkyl radical having 19 carbon atoms), 21-hentetracontanone ($R^7$ and $R^8$ is an alkyl radical having 20 carbon atoms) and/or behenone (22-triatetracontanone; $R^9$ and $R^{10}$ is an alkyl radical having 21 carbon atoms).

Further suitable antifoams are fatty acid polyethylene glycol esters of the formula (VIII), $$R^{11}COO(CH_2CH_2O)_nH \quad \text{(VIII)}$$

in which $R^{11}CO$ is a linear or branched, aliphatic, saturated and/or unsaturated acyl radical having 6 to 22 carbon atoms and n is a number from 0.5 to 1.5. Such fatty acid polyethylene glycol esters are preferably obtained by basic-homogeneously catalyzed addition of ethylene oxide onto fatty acids, the addition of ethylene oxide onto the fatty acids taking place in particular in the presence of alkanolamines as catalysts. The use of alkanolamines, specifically triethanolamine, leads to a highly selective ethoxylation of the fatty acids, particularly when the compounds to be prepared have low degrees of ethoxylation. For the purposes of the present invention, preference is given to fatty acid polyethylene glycol esters of the formula (VIII) in which $R^{11}CO$ is a linear acyl radical having 12 to 18 carbon atoms and n is 1. Lauric acid ethoxylated with 1 mol of ethylene oxide is particularly suitable. Within the group of fatty acid polyethylene glycol esters, preference is given to those which have a melting point above 25° C., in particular above 40° C.

Within the group of wax-like antifoams, particular preference is given to using the described paraffin waxes alone as wax-like antifoams, or in a mixture with one of the other wax-like antifoams, where the proportion of the paraffin waxes in the mixture preferably constitutes more than 50% by weight—based on wax-like antifoam mixture.

The paraffin waxes can be applied to carriers if required. Suitable carrier materials are all known inorganic and/or organic carrier materials. Examples of typical inorganic carrier materials are alkali metal carbonates, alumosilicates, water-soluble phyllosilicates, alkali metal silicates, alkali metal sulfates, for example sodium sulfate, and alkali metal phosphates. The alkali metal silicates are preferably a compound with a molar ratio of alkali metal oxide to $SiO_2$ of from 1:1.5 to 1:3.5. The use of such silicates results in particularly good particle properties, in particular high abrasion stability and nevertheless high dissolution rate in water. The aluminosilicates referred to as carrier material include, in particular, the zeolites, for example zeolite NaA and NaX. The compounds referred to water-soluble phyllosilicates include, for example, amorphous or crystalline water glass. In addition, use is made of silicates which are commercially available under the name Aerosil® or Sipernat®. Suitable organic carrier materials are, for example, film-forming polymers, for example polyvinyl alcohols, polyvinylpyrrolidones, poly(meth)acrylates, polycarboxylates, cellulose derivatives and starch. Cellulose ethers which can be used are, in particular, alkali metal carboxymethylcellulose, methylcellulose, ethylcellulose, hydroxyethylcellulose and cellulose mixed ethers, such as, for example, methylhydroxyethylcellulose and methylhydroxypropylcellulose, and mixtures thereof. Particularly suitable mixtures are composed of sodium carboxymethylcellulose and methylcellulose, where the carboxymethylcellulose usually has a degree of substitution of from 0.5 to 0.8 carboxymethyl groups per anhydroglucose unit and the methylcellulose has a degree of substitution of from 1.2 to 2 methyl groups per anhydroglucose unit. The mixtures preferably comprise alkali metal carboxymethylcellulose and nonionic cellulose ethers in weight ratios of from 80:20 to 40:60, in particular from 75:25 to 50:50. Also suitable as carrier is native starch which is constructed from amylose and amylopectin. Native starch is the term used for starch as is available as extract from natural sources, for example from rice, potatoes, corn and wheat. Native starch is a commercially available product and thus readily available. Carrier materials which can be used are individual or two or more of the abovementioned compounds, in particular chosen from the group of alkali metal carbonates, alkali metal sulfates, alkali metal phosphates, zeolites, water-soluble phyllosilicates, alkali metal silicates, polycarboxylates, cellulose ethers, polyacrylate/polymethacrylate and starch. Mixtures of alkali metal carbonates, in particular sodium carbonate, alkali metal silicates, in particular sodium silicate, alkali metal sulfates, in particular sodium sulfate, and zeolites are particularly suitable.

According to a further embodiment of the present invention, the antifoam used is a mixture of at least one wax-like antifoam, preferably a paraffin wax, and a defoaming silicone compound. For the purposes of the present invention, suitable silicones are customary organopolysiloxanes which may have a content of finely divided silica, which may in turn also be silanized. Such organopolysiloxanes are described, for example, in European patent application EP 0496510 A1. Particular preference is given to polydiorganosiloxanes which are known from the prior art. Suitable polydiorganosiloxanes can have a virtually linear chain and are characterized according to the following formula (IX),

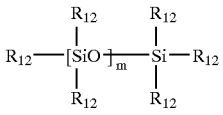

(IX)

where $R^{12}$, independently of the others, may be an alkyl or an aryl radical and m may be a number in the range from 40 to 1500. Examples of suitable substituents $R^{12}$ are methyl, ethyl, propyl, isobutyl, tert-butyl and phenyl. It is, however, also possible to use compounds crosslinked via siloxane, as are known to the person skilled in the art under the name silicone resins. The polydiorganosiloxanes usually comprise finely divided silica, which may also be silanized. Silica-containing dimethylpolysiloxanes are particularly suitable. The polydiorganosiloxanes preferably have a Brookfield viscosity at 25° C. in the range from 5000 mPas to 30000 mPas, in particular from 15000 to 25000 mPas. The silicones are preferably applied to carrier materials. Suitable carrier materials have already been described in connection with the paraffins. The carrier materials are generally present in amounts of from 40 to 90% by weight, preferably in amounts of from 45 to 75% by weight—based on antifoam.

For the purposes of the invention, it is preferable to make do with the lowest possible amounts of silicone antifoams, and the content of silicone in the mixtures containing the wax-like antifoams is preferably at most 50% by weight, preferably at most 30% by weight—based on active substance content of the antifoams.

Further Optional Detergent Constituents

Further preferred ingredients of the solid detergents are inorganic and organic builder substances, the inorganic builder substances used mainly being zeolites, crystalline phyllosilicates and amorphous silicates with builder properties, and, where permissible, also phosphates, such as tripolyphosphates. The builder substances are preferably present in the detergents according to the invention in amounts of from 10 to 60% by weight—based on detergent.

The finely crystalline synthetic and bonded-water-containing zeolite often used as detergent builder is preferably zeolite A and/or P. A particularly preferred zeolite P is, for example, zeolite MAP® (commercial product from Crosfield). Also suitable, however, are zeolite X, and mixtures of A, X and/or P, and also Y. A cocrystallized sodium/potassium alumosilicate of zeolite A and zeolite X, which is available commercially as VEGOBOND AX® (commercial product from Condea Augusta S.p.A.), is of particular interest. The zeolite can be used as spray-dried powder or else as undried stabilized suspension which is still moist from its preparation. In cases where the zeolite is used as suspension, this may comprise small additions of nonionic surfactants as stabilizers, for example 1 to 3% by weight, based on zeolite, of ethoxylated $C_{12}$–$C_{18}$-fatty alcohols having 2 to 5 ethylene oxide groups, $C_{12}$–$C_{14}$-fatty alcohols having 4 to 5 ethylene oxide groups or ethoxylated isotridecanoles. Suitable zeolites have an average particle size of less than 10 $\mu$m (volume distribution; measurement method: Coulter Counter) and preferably comprise 18 to 22% by weight, in particular 20 to 22% by weight, of bonded water.

Suitable substitutes or partial substitutes for phosphates and zeolites are crystalline, layered sodium silicates of the general formula $NaMSi_xO_{2x+1}.yH_2O$, where M is sodium or hydrogen, x is a number from 1.9 to 4 and y is a number from 0 to 20, and preferred values for x are 2, 3 or 4. Such crystalline phyllosilicates are described, for example, in European patent application EP 0164514 A1. Preferred crystalline phyllosilicates of the given formula are those in which M is sodium and x assumes the values 2 or 3. In particular, preference is given to both β- and also δ-sodium disilicates $Na_2Si_2O_5.yH_2O$, where β-sodium disilicate can, for example, be obtained by the process described in International patent application WO 91/08171. Further suitable phyllosilicate are known, for example, from patent applications DE 2334899 A1, EP 0026529 A1 and DE 3526405 A1. Their applicability is not limited to a specific composition or structural formula. Preference is, however, given here to smectites, in particular bentonites. Suitable phyllosilicates, which belong to the group of water-swellable smectites, are, for example, those of the general formulae

| | |
|---|---|
| $(OH)_4Si_{8-y}Al_y(Mg_xAl_{4-x})O_{20}$ | montmorrilonite |
| $(OH)_4Si_{8-y}Al_y(Mg_{6-z}Li_z)O_{20}$ | hectorite |
| $(OH)_4Si_{8-y}Al_y(Mg_{6-z}Al_z)O_{20}$ | saponite |

where x=0 to 4, y=0 to 2, z=0 to 6. In addition, small amounts of iron can be incorporated into the crystal lattice of the phyllosilicates according to the above formulae. In addition, the phyllosilicates can, on the basis of their ion exchanging properties, comprise hydrogen ions, alkali metal ions, alkaline earth metal ions, in particular $Na^+$ and $Ca^{2+}$. The amount of water of hydration is in most cases in the range from 8 to 20% by weight and is dependent on the swelling state or on the type of processing. Phyllosilicates which can be used are known, for example, from U.S. Pat. Nos. 3,966,629, 4,062,647, EP 0026529 A1 and EP 0028432 A1. Preference is given to using phyllosilicates which, as a result of an alkali treatment, are largely free from calcium ions and intensely coloring iron ions.

The preferred builder substances also include amorphous sodium silicates with an $Na_2O:SiO_2$ modulus of from 1:2 to 1:3.3, preferably from 1:2 to 1:2.8 and in particular from 1:2 to 1:2.6, which have delayed dissolution and secondary detergency properties. Delayed dissolution compared with conventional amorphous sodium silicates can be brought about in a variety of ways, for example by surface treatment, compounding, compaction/compression or by overdrying. For the purposes of this invention, the term "amorphous" also includes "X-ray-amorphous". This means that, in X-ray diffraction experiments, the silicates do not produce sharp X-ray reflections typical of crystalline substances, but, at best, one or more maxima of the scattered X-ray radiation having a breadth of several degree units of the diffraction angle. However, particularly good builder properties may very likely result if the silicate particles produce poorly defined or even sharp diffraction maxima in electron diffraction experiments. This is to be interpreted to the effect that the products have microcrystalline regions with a size from 10 to a few hundred nm, preference being given to values up to a maximum of 50 nm and in particular up to a maximum of 20 nm. Such X-ray-amorphous silicates, which likewise have delayed dissolution compared with traditional water glasses, are described, for example, in German patent application DE 4400024 A1. Particular preference is given to compressed/compacted amorphous silicates, compounded amorphous silicates and overdried X-ray-amorphous silicates.

A use of the generally known phosphates as builder substances is of course also possible provided such a use is not to be avoided for ecological reasons. Suitable compounds are, in particular, the sodium salts of orthophosphates, of pyrophosphates and in particular of tripolyphosphates. Their content is generally not more than 30% by weight, preferably not more than 25% by weight, in each case based on the finished composition. In some cases, it has been found that tripolyphosphates in particular, even in small amounts up to at most 10% by weight, based on the finished composition, in combination with other builder substances lead to a synergistic improvement in the secondary detergency.

Organic builders which can be used are, for example, the polycarboxylic acids which can be used in the form of their sodium salts, such as citric acid, adipic acid, succinic acid, glutaric acid, tartaric acid, sugar acids, aminocarboxylic acids, nitrilotriacetic acid (NTA), provided such a use is not objectionable on ecological grounds, and also mixtures thereof. Preferred salts are the salts of polycarboxylic acids, such as citric acid, adipic acid, succinic acid, glutaric acid, tartaric acid, sugar acids and mixtures thereof. The acids per se can also be used. Apart from their builder action, the acids typically also have the property of an acidification component and thus also serve to establish a lower and more mild pH of detergents and cleaners. In particular, mention is made here of citric acid, succinic acid, glutaric acid, adipic acid, gluconic acid and any mixtures thereof.

Further suitable organic builder substances are dextrins, for example oligomers or polymers of carbohydrates which can be obtained by partial hydrolysis of starches. The hydrolysis can be carried out in accordance with customary, for example acid- or enzyme-catalyzed, processes. The hydrolysis products preferably have average molar masses in the range from 400 to 500000. Here, preference is given to a polysaccharide with a dextrose equivalent (DE) in the range from 0.5 to 40, in particular from 2 to 30, where DE is a useful measure of the reducing action of a polysaccharide compared with dextrose, which has a DE of 100. It is also possible to use maltodextrins with a DE between 3 and 20 and dry glucose syrups with a DE between 20 and 37 and also yellow dextrins and white dextrins with higher molar masses in the range from 2000 to 30000. A preferred dextrin is described in British patent application GB 9419091 A1. The oxidized derivatives of such dextrins are their reaction products with oxidizing agents which are able to oxidize at least one alcohol function of the saccharide ring to give the carboxylic acid function. Such oxidized dextrins and processes for their preparation are known, for example, from European patent applications EP 0232202 A1, EP 0427349 A1, EP 0472042 A1 and EP 0542496 A1, and International patent applications WO 92/18542, WO 93/08251, WO 93/16110, WO 94/28030, WO 95/07303, WO 95/12619 and WO 95/20608. Also suitable is an oxidized oligosaccharide according to German patent application DE 19600018 A1. A product oxidized on $C_6$ of the saccharide ring may be particularly advantageous.

Further suitable cobuilders are oxydisuccinates and other derivatives of disuccinates, preferably ethylenediamine disuccinate. In this connection, particular preference is also given to glycerol disuccinates and glycerol trisuccinates, as are described, for example, in US-American patent specifications U.S. Pat. Nos. 4,524,009, 4,639,325, in European patent application EP 0150930 A1 and Japanese patent application JP 93/339896. Suitable use amounts in zeolite-containing and/or silicate-containing formulations are 3 to 15% by weight.

Further organic cobuilders which can be used are, for example, acetylated hydroxycarboxylic acids or salts thereof, which may optionally also be in lactone form and which contain at least 4 carbon atoms and at least one hydroxyl group and a maximum of two acid groups. Such cobuilders are described, for example, in International patent application WO 95/20029.

Suitable polymeric polycarboxylates are, for example, the sodium salts of polyacrylic acid or of polymethacrylic acid, for example those with a relative molecular mass of from 800 to 150000 (based on acid and in each case measured against polystyrenesulfonic acid). Suitable copolymeric polycarboxylates are, in particular, those of acrylic acid with methacrylic acid and of the acrylic acid or methacrylic acid with maleic acid. Copolymers of acrylic acid with maleic acid which comprise 50 to 90% by weight of acrylic acid and 50 to 10% by weight of maleic acid are particularly suitable.

Their relative molecular mass, based on free acids, is generally 5000 to 200000, preferably 10000 to 120000 and in particular 50000 to 100000 (in each case measured against polystyrenesulfonic acid). The (co)polymeric polycarboxylates can either be used as powder or as aqueous solution, 20 to 55% strength by weight aqueous solutions being preferred. Granular polymers are in most cases added subsequently to one or more base granulates. Particular preference is also given to biodegradable polymers of more than two different monomer units, for example those which, according to DE 4300772 A1, comprise, as monomers, salts of acrylic acid and of maleic acid, and vinyl alcohol and vinyl alcohol derivatives or, according to DE 4221381 C2, comprise, as monomers, salts of acrylic acid and of 2-alkylallylsulfonic acid, and sugar derivatives. Further preferred copolymers are those described in German patent applications DE 4303320 A1 and DE 4417734 A1 and preferably have acrolein and acrylic acid/acrylic acid salts or acrolein and vinyl acetate as monomers. Further preferred builder substances which are likewise to be mentioned are polymeric aminodicarboxylic acids, salts thereof or precursor substances thereof. Particular preference is given to polyaspartic acids or salts and derivatives thereof.

Further suitable builder substances are polyacetals which can be obtained by reacting dialdehydes with polyolcarboxylic acids, which have 5 to 7 carbon atoms and at least 3 hydroxyl groups, for example as described in European patent application EP 0280223 A1. Preferred polyacetals are obtained from dialdehydes such as glyoxal, glutaraldehyde, terephthalaldehyde, and mixtures thereof, and from polyolcarboxylic acids, such as gluconic acid and/or glucoheptonic acid.

In addition, the compositions may also comprise components which have a positive effect on the ease with which oil and grease are washed out of textiles. Preferred oil- and grease-dissolving components include, for example, nonionic cellulose ethers, such as methylcellulose and methylhydroxypropylcellulose with a proportion of methoxy groups of from 15 to 30% by weight and of hydroxypropoxy groups of from 1 to 15% by weight, in each case based on the nonionic cellulose ethers, and the polymers, known from the prior art, of phthalic acid and/or of terephthalic acid or of derivatives thereof, in particular polymers of ethylene terephthalates and/or polyethylene glycol terephthalates or anionically and/or nonionically modified derivatives thereof. Of these, particular preference is given to the sulfonated derivatives of phthalic acid polymers and of terephthalic acid polymers.

Further suitable ingredients of the compositions are water-soluble inorganic salts, such as bicarbonates, carbonates, amorphous silicates, normal waterglasses, which have no special builder properties, or mixtures thereof; in particular, alkali metal carbonate and/or amorphous alkali metal silicate, primarily sodium silicate with an $Na_2O:SiO_2$ molar ratio of from 1:1 to 1:4.5, preferably from 1:2 to 1:3.5. The content of sodium carbonate in the detergents according to the invention is here preferably up to 40% by weight, advantageously between 2 and 35% by weight. The content of sodium silicate (without particular builder properties) in the compositions is generally up to 10% by weight and preferably between 1 and 8% by weight.

Apart from said ingredients, the compositions can comprise further known additives used customarily in detergents, for example salts of polyphosphonic acids, optical brighteners, enzymes, enzyme stabilizers, small amounts of neutral filling salts, and dyes and fragrances, opacifiers or pearlizing agents.

Of the compounds which serve as bleaches and produce $H_2O_2$ in water, sodium perborate tetrahydrate and sodium perborate monohydrate are of particular importance. Further bleaches which can be used are, for example, sodium percarbonate, peroxypyrophosphates, citrate perhydrates, and $H_2O_2$-producing peracidic salts or peracids, such as perbenzoates, peroxophthalates, diperazelaic acid, phthaloiminoperacid or diperdodecanedioic acid. The content of bleaches in the compositions is preferably 5 to 35% by weight and in particular up to 30% by weight, with perborate monohydrate or percarbonate advantageously being used.

Bleach activators which may be used are compounds which under perhydrolysis conditions produce aliphatic peroxocarboxylic acids having preferably 1 to 10 carbon atoms, in particular 2 to 4 carbon atoms, and/or optionally substituted perbenzoic acid. Suitable substances are those which carry O- and/or N-acyl groups of said number of carbon atoms and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl or isononanoyl oxybenzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran and the enol esters known from German patent applications DE 19616693 A1 and DE 19616767 A1, and also acetylated sorbitol and mannitol or mixtures thereof (SORMAN) described in European patent application EP 0525239 A1, acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example N-benzoylcaprolactam, which are known from International patent applications WO 94/27970, WO 94/28102, WO 94/28103, WO 95/00626, WO 95/14759 and WO 95/17498. The hydrophilically substituted acylacetals known from German patent application DE 19616769 A1 and the acyllactams described in German patent application DE 196 16 770 and International patent application WO 95/14075 are likewise preferably used. The combinations of conventional bleach activators known from German patent application DE 4443177 A1 can also be used. Such bleach activators are present in the customary quantitative range, for example in amounts of from 1% by weight to 10% by weight, in particular 2% by weight to 8% by weight, based on the total composition. In addition to the abovementioned conventional bleach activators, or instead of them, it is also possible for the sulfonimines and/or bleach-boosting transition metal salts or transition metal complexes known from the European patent specifications EP 0446982 B1 and EP 0453 003 B1 to be present as bleach catalysts. Suitable transition metal compounds include, in particular, the manganese-, iron-, cobalt-, ruthenium- or molybdenum-salen complexes known from German patent application DE 19529905 A1, and their N-analogous compounds known from German patent application DE 19620267 A1, the manganese-, iron-, cobalt-, ruthenium- or molybdenum-carbonyl complexes known from German patent application DE 19536082 A1, manganese, iron, cobalt, ruthenium, molybdenum, titanium, vanadium and copper complexes with N-containing tripod ligands described in German patent application DE 196 05 688, the cobalt-, iron-, copper- and ruthenium-amine complexes known from German patent application DE 19620411 A1, the manganese, copper and cobalt complexes described in German patent application DE 4416438 A1, the cobalt complexes described in European patent application EP 0272030 A1, the manganese complexes known from European patent application EP 0693550 A1, the manganese, iron, cobalt and copper complexes known from European patent specification EP 0392592 A1 and/or the manganese complexes described in European patent specification EP 0443651 B1 or the European patent applications EP 0458397 A1, EP 0458398 A1, EP 0549271 A1, EP 0549272 A1, EP 0544490 A1 and EP 0544519 A1. Combinations of bleach activators and transition metal bleach catalysts are known, for example, from German patent application DE 19613103 A1 and International patent application WO 95/27775. Bleach-boosting transition metal complexes, in particular those with the central atoms Mn, Fe, Co, Cu, Mo, V, Ti and/or Ru, are used in customary amounts, preferably in an amount up to 1% by weight, in particular from 0.0025% by weight to 0.25% by weight and particularly preferably from 0.01% by weight to 0.1% by weight, in each case based on the total composition.

Suitable enzymes are, in particular, those from the class of hydrolases, such as proteases, esterases, lipases and enzymes with lipolytic action, amylases, cellulases or other glycosyl hydrolases and mixtures of said enzymes. In the washing, all of these hydrolases contribute to the removal of stains, such as proteinacous, fatty or starchy marks, and graying. Cellulases and other glycosyl hydrolases may contribute to the retention of color and to an increase in the softness of the textile by removing pilling and microfibrils. For bleaching and/or for inhibiting color transfer, it is also possible to use oxidoreductases. Especially suitable enzymatic active ingredients are those obtained from bacterial strains or fungi, such as Bacillus subtilis, Bacillus licheniformis, Streptomyces griseus and Humicola insolens. Preference is given to using proteases of the Subtilisin type, and especially to proteases obtained from Bacillus lentus. Of particular interest in this context are enzyme mixtures, for example of protease and amylase or protease and lipase or enzymes with a lipolytic action or protease and cellulase or of cellulase and lipase or enzymes with a lipolytic action or of protease, amylase and lipase or enzymes with a lipolytic action or protease, lipase or enzymes with a lipolytic action and cellulase, but in particular protease- and/or lipase-containing mixtures or mixtures containing enzymes with a lipolytic action. Examples of such enzymes with a lipolytic action are the known cutinases. Peroxidases or oxidases have also proven suitable in some cases. Suitable amylases include, in particular, α-amylases, isoamylases, pullulanases and pectinases. The cellulases used are preferably cellobiohydrolases, endoglucanases and β-glucosidases, which are also called cellobiases, or mixtures thereof. Because different types of cellulase differ in their CMCase and avicelase activities, specific mixtures of the cellulases may be used to establish the desired activities.

The enzymes can be adsorbed to carrier substances and/or be embedded in coating substances in order to protect them from premature decomposition. The proportion of enzymes, enzyme mixtures or enzyme granulates can, for example, be about 0.1 to 5% by weight, preferably 0.1 to about 2% by weight.

In addition to the mono- and polyfunctional alcohols, the compositions can comprise further enzyme stabilizers. For example, 0.5 to 1% by weight of sodium formate can be used. The use of proteases stabilized with soluble calcium salts and a calcium content of preferably about 1.2% by weight, based on the enzyme, is also possible. Apart from calcium salts, magnesium salts also serve as stabilizers. However, the use of boron compounds, for example of boric acid, boron oxide, borax and other alkali metal borates, such as the salts of orthoboric acid ($H_3BO_3$), of metaboric acid ($HBO_2$) and of pyroboric acid (tetraboric acid $H_2B_4O_7$) is particularly advantageous.

Graying inhibitors have the function of keeping the soil detached from the fiber suspended in the liquor, thus preventing reattachment of the soil. Suitable for this purpose are water-soluble colloids, usually organic in nature, examples being the water-soluble salts of polymeric carboxylic acids, glue, gelatin, salts of ether carboxylic acids or ether sulfonic acids of starch or of cellulose or salts of acidic sulfuric esters of cellulose or of starch. Water-soluble polyamides containing acidic groups are also suitable for this purpose. Furthermore, soluble starch preparations and starch products other than those mentioned above may be used, e.g. degraded starch, aldehyde starches, etc. Polyvinylpyrrolidone may also be used. Preference, however, is given to using cellulose ethers, such as carboxymethyl cellulose (Na salt), methyl cellulose, hydroxyalkyl cellulose and mixed ethers, such as methylhydroxyethyl cellulose, methylhydroxypropyl cellulose, methylcarboxymethyl cellulose and mixtures thereof, and polyvinylpyrrolidone, for example in amounts of from 0.1 to 5% by weight, based on the compositions.

The compositions may comprise, as optical brighteners, derivatives of diaminostilbenedisulfonic acid or alkali metal salts thereof. Examples of suitable salts of 4,4'-bis(2-anilino-4-morpholino-1,3,5-triazinyl-6-amino)stilbene-2,2'-disulfonic acid or compounds of a similar structure which carry a diethanolamino group, a methylamino group, an anilino group or a 2-methoxyethylamino group instead of the morpholino group. Furthermore, brighteners of the substituted diphenylstyryl type may be present, e.g. the alkali metal salts of 4,4'-bis(2-sulfostyryl)diphenyl, 4,4'-bis(4-chloro-3-sulfostyryl)diphenyl or 4-(4-chlorostyryl)-4'-(2-sulfostyryl)diphenyl. It is also possible to use mixtures of the abovementioned brighteners. Uniformly white granulates are obtained if the compositions comprise, apart from the customary brighteners in customary amounts, for example between 0.1 and 0.5% by weight, preferably between 0.1 and 0.3% by weight, also small amounts, for example $10^{-6}$ to $10^{-3}$% by weight, preferably around $10^{-5}$% by weight, of a blue dye. A particularly preferred dye is Tinolux® (commercial product from Ciba-Geigy).

Suitable soil repellant polymers are those substances which preferably contain ethylene terephthalate and/or polyethylene glycol terephthalate groups, where the molar ratio of ethylene terephthalate to polyethylene glycol terephthalate may be in the range from 50:50 to 90:10. The molecular weight of the linking polyethylene glycol units is in particular in the range from 750 to 5000, i.e. the degree of ethoxylation of the polyethylene glycol group-containing polymers may be about 15 to 100. The polymers are characterized by an average molecular weight of from about 5000 to 200000 and can have a block structure, but preferably have a random structure. Preferred polymers are those with ethylene terephthalate/polyethylene glycol terephthalate molar ratios of from about 65:35 to about 90:10, preferably from about 70:30 to 80:20. In addition, preference is given to those polymers which have linking polyethylene glycol units with a molecular weight of from 750 to 5000, preferably from 1000 to about 3000 and a molecular weight of the polymer of from about 10000 to about 50000. Examples of commercially available polymers are the products Milease® T (ICI) or Repelotex® SRP 3 (Rhône-Poulenc).

Perfume oils or fragrances which can be used are individual odorant compounds, e.g. the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lilial and bourgeonal, the ketones include, for example, the ionones, α-isomethylionone and methyl cedryl ketone, the alcohols include anethole, citronellol, eugenol, geraniol, linalool, phenylethyl alcohol and terpineol, and the hydrocarbons include mainly the terpenes, such as limonene and pinene. Preference is, however, given to using mixtures of different odorants which together produce a pleasing fragrance note. Such perfume oils can also contain natural odorant mixtures, as are obtainable from plant sources, e.g. pine oil, citrus oil, jasmine oil, patchouli oil, rose oil or ylang ylang oil. Likewise suitable are clary sage oil, chamomile oil, clove oil, melissa oil, mint oil, cinnamon leaf oil, lime blossom oil, juniperberry oil, vetiver oil, olibanum oil, galbanum oil and labdanum oil, and also orange blossom oil, neroliol, orange peel oil and sandalwood oil.

The fragrances can be incorporated directly into the compositions according to the invention, although it may also be advantageous to apply the fragrances to carriers which intensify adhesion of the perfume to the laundry and, as a result of a slower fragrance release, provide for long-lasting fragrance of the textiles. Cyclodextrins have, for example, proven useful as such carrier materials, where the cyclodextrin-perfume complexes can additionally be coated with further auxiliaries.

If desired, the detergents according to the invention can also comprise inorganic salts as fillers or extenders, such as, for example, sodium sulfate, which is preferably present in amounts of from 0 to 40% by weight, in particular 1 to 30% by weight—based on composition.

Preparation

The detergents according to the invention can be prepared and used in the form of powders, extrudates, granulates or tablets. To prepare such compositions, the corresponding processes known from the prior art are suitable. The compositions are preferably prepared by mixing together various particulate components which comprise detergent ingredients.

In this process, the particulate components can be prepared by spray drying, simple mixing or complex granulation processes, for example fluidized bed granulation. In this connection, it is particularly preferred for at least one surfactant-containing component to be prepared by fluidized bed granulation. In addition, it may be particularly preferred if aqueous preparations of the alkali metal silicate and of the alkali metal carbonate are sprayed together with other detergent ingredients in a drying device, it being possible for granulation to take place at the same time as the drying.

The drying device into which the aqueous preparation is sprayed can be any desired drying apparatus. In a preferred process embodiment, the drying is carried out as spray drying in a drying tower. For this, the aqueous preparations are subjected, in a known manner, to a drying gas stream in finely divided form. The applicant describes an embodiment of spray drying with superheated steam in a number of publications. The operating principle disclosed therein is thus expressly also included in the subject-matter of the present inventive disclosure. Reference is made in this connection in particular to the following publications: DE 4030688 A1 and the continuing publications according to

| | | |
|---|---|---|
| DE 4204035 A1; | DE 4204090 A1; | DE 4206050 A1; |
| DE 4206521 A1; | DE 4206495 A1; | DE 4208773 A1; |
| DE 4209432 A1 and DE 4234376 A1. | | |

In another preferred variant, in particular if compositions of high bulk density are to be obtained, the mixtures are then subjected to a compacting step, further ingredients only being added to the compositions after the compacting step. Compaction of the ingredients takes place in a preferred embodiment of the invention in a compression agglomeration process. The compression agglomeration operation to which the solid premix (dried base detergent) is subjected can be realized in various apparatuses. Depending on the type of agglomerator used, various compression agglomeration processes are differentiated. The four most common and preferred compression agglomeration processes for the purposes of the present invention are extrusion, roll compression or compaction, perforation compression (pelleting) and tableting, meaning that, for the purposes of the present invention, preferred compression agglomeration operations are extrusion, roll compaction, pelleting or tableting operations.

A common feature of all of these processes is that the premix is compacted under pressure and plasticized and the individual particles are pressed together, with a reduction in the porosity, and adhere to one another. In all of the processes (in the case of tableting with limitations), the tools can be heated to relatively high temperatures or cooled to dissipate the heat which forms as a result of shear forces.

In all of the processes, one or more binders can be used as auxiliary for the compression. In this connection, however, it should be clarified that the use of two or more different binders and mixtures of different binders is also always possible in itself. In a preferred embodiment of the invention, a binder is used which is already completely in the form of a melt at temperatures up to at most 130° C., preferably up to at most 100° C. and in particular up to 90° C. The binder must thus be chosen depending on the process and process conditions, or the process conditions, in particular the process temperature, have to be adapted—if a certain binder is desired—to the binder.

The actual compression process is preferably carried out at processing temperatures which at least in the compression step correspond to at least the temperature of the softening point if not even the temperature of the melting point of the binder. In a preferred embodiment of the invention, the processing temperature is significantly greater than the melting point or greater than the temperature at which the binder is in the form of a melt. In particular, however, it is preferred that the processing temperature in the compression step is not more than 20° C. above the melting temperature or the upper limit of the melting range of the binder. Although it is technically entirely possible to establish even higher temperatures, it has, however, been found that a temperature difference relative to the melting temperature or to the softening temperature of the binder of 20° C. is generally entirely adequate and even higher temperatures do not afford any additional advantages. For this reason, it is particularly preferred—in particular also for energetic reasons—to work above, but as close as possible, to the melting point or to the upper temperature limit of the melting range of the binder. Such a temperature control has the added advantage that thermally sensitive raw materials, for example peroxy bleaches, such as perborate and/or percarbonate, and also enzymes, can also be increasingly processed without serious losses of active substance. The possibility of exact temperature control of the binder, in particular in the decisive step of compression, i.e. between mixing/homogenization of the premix and shaping, permits an energetically very favorable process control which is extremely gentle for the temperature-sensitive constituents of the premix since the premix is only exposed to the higher temperatures for a short period. In preferred compression agglomeration processes, the processing tools of the compression agglomerator (the screw(s) of the extruder, the roll(s) of the roll compactor and the compression roll(s) of the pelleting press) have a temperature of at most 150° C., preferably at most 100° C. and in particular at most 75° C., and the processing temperature is 30° C. and in particular at most 20° C. above the melting temperature or the upper temperature limit of the melting range of the binder. The duration of the temperature effect in the compression zone of the compression agglomerators is at most 2 minutes and is in particular in a range between 30 seconds and 1 minute.

Preferred binders, which can be used alone or in a mixture with other binders, are polyethylene glycols, 1,2-polypropylene glycols, and modified polyethylene glycols and polypropylene glycols. Modified polyalkylene glycols include, in particular, the sulfates and/or the disulfates of polyethylene glycols or polypropylene glycols with a relative molecular mass between 600 and 12000 and in particular between 1000 and 4000. A further group consists of mono- and/or disuccinates of the polyalkylene glycols, which in turn have relative molecular masses between 600 and 6000, preferably between 1000 and 4000. For a more precise description of the modified polyalkylene glycol ethers, reference is made to the disclosure of International patent application WO 93/02176. For the purposes of this invention, polyethylene glycols include those polymers for whose preparation, as well as ethylene glycol, $C_3$–$C_5$-glycols, and glycerol and mixtures thereof are likewise used as starting molecules. In addition, ethoxylated derivatives, such as trimethylolpropane having 5 to 30 EO are included. The preferred polyethylene glycols can have a linear or branched structure, preference being given in particular to linear polyethylene glycols. Particularly preferred polyethylene glycols include those with relative molecular masses between 2000 and 12000, advantageously around 4000, where it is possible to use polyethylene glycols with relative molecular masses below 3500 and above 5000, in particular in combination with polyethylene glycols with a relative molecular mass around 4000, and such combinations advantageously have more than 50% by weight, based on the total amount of polyethylene glycols, of polyethylene glycols with a relative molecular mass between 3500 and 5000. Binders which can be used, however, are also polyethylene glycols which are per se in liquid state at room temperature and a pressure of 1 bar; polyethylene glycol with a relative molecular mass of 200, 400 and 600 is primarily However, these polyethylene glycols, which are liquid per se, should only be used in the mixture with at least one other binder, this mixture again having to satisfy the requirements according to the invention, i.e. must have a melting point or softening point of at least more than 45° C. Other suitable binders are lower molecular weight polyvinylpyrrolidones and derivatives thereof having relative molecular masses up to at most 30000. Preference is given here to relative molecular mass ranges between 3000 and 30000, for example around 10000. Polyvinylpyrrolidones are preferably not used as the sole binder, but in combination with others, in particular in combination with polyethylene glycols.

Directly after leaving the preparation apparatus, the compressed material preferably has temperatures not exceeding 90° C., temperatures between 35 and 85° C. being particularly preferred. It has been found that exit temperatures—primarily in extrusion processes—of from 40 to 80° C., for example up to 70° C., are particularly advantageous.

In a preferred embodiment, the laundry detergent according to the invention is prepared by means of extrusion, as described, for example, in European patent EP 0486592 B1 or International patent applications WO 93/02176 and WO 94/09111 and WO 98/12299. In this process, a solid premix is compressed in the form of strands under pressure and, after leaving the perforated die, the strand is cut to the predeterminable granulate dimension by means of a cutting device. The homogeneous and solid premix comprises a plasticizer and/or lubricant, which means that the premix softens plastically and becomes extrudable under the pressure or the input of specific work. Preferred plasticizers and/or lubricants are surfactants and/or polymers. To explain the actual extrusion process, reference is expressly made here to the abovementioned patents and patent applications. In this connection, the premix is preferably fed to a planetary roll extruder or a 2-shaft extruder or 2-screw extruder with coacting or counteracting screw control, the housing of which and the extruder granulation head of which can be heated to the predetermined extrusion temperature. Under the shear action of the extruder screws, the premix is compressed under pressure, which is preferably at least 25 bar, but can also be lower in cases of extremely high throughputs and depending on the apparatus used, plasticized, extruded in the form of fine strands through the perforated die plate in the extruder head and finally the extrudate is comminuted using a rotating chopping knife preferably to give approximately spherical to cylindrical granulate particles. The perforation diameter of the perforated die plate and the strand section length are matched to the chosen granular dimension. Thus, the preparation of granulates of an essentially uniformly predeterminable particle size is possible, it being possible, in individual cases, to match the absolute particle sizes to the intended use purpose. In general, particle diameters up to at most 0.8 cm are preferred. Important embodiments here provide the preparation of uniform granulates in the millimeter range, for example in the range from 0.5 to 5 mm and in particular in the range from about 0.8 to 3 mm. The length/diameter ratio of the chopped primary granulates is here preferably in the range from about 1:1 to about 3:1. It is also preferred to pass the still plastic primary granulate to a further shaping processing step; here, edges present on the crude extrudate are rounded, meaning that ultimately it is possible to obtain spherical to approximately spherical extrudate particles. If desired, small amounts of dry powder, for example zeolite powder, such as zeolite NaA powder, can be co-used in this stage. This shaping can be carried out in rounding devices. Here, it must be ensured that only small amounts of fines arise in this stage. Drying, which is described in the abovementioned documents of the prior art as preferred embodiment is then possible, but not obligatory. It may be preferable not to carry out any more drying after the compaction step. Alternatively, extrusions/compressions can also be carried out in low-pressure extruders, in the Kahl press (Amandus Kahl) or in a Bextruder from Bepex. The temperature is preferably controlled in the transition zone of the screw, of the predistributor and of the die plate in such a way that the melting temperature of the binder or the upper limit of the melting range of the binder is at least reached, but preferably exceeded. In this connection, the duration of the temperature effect in the compression zone of the extrusion is preferably below 2 minutes and in particular in a range between 30 seconds and 1 minute.

The laundry detergents according to the invention can also be prepared by means of roll compaction. Here, the premix is fed in in a targeted manner between two smooth rolls or rolls provided with indentations of defined shape, and rolled out between the two rolls under pressure to give a sheetlike compact, so-called flakes. The rolls exert a high linear pressure on the premix and can, if required, additionally be heated or chilled. The use of smooth rolls gives smooth, unstructured flake strands, while the use of structured rolls can produce correspondingly structured flakes in which, for example, certain shapes of the latter detergent particles can be preset. The flake strand is then broken into smaller sections by a chopping and comminution operation and can be processed in this way to give granulate particles which can be finished by further surface-treatment processes known per se, in particular can be converted to an approximately spherical shape. In the case of roll compaction too, the temperature of the pressing tools, i.e. of the rolls, is preferably at most 150° C., preferably at most 100° C. and in particular at most 75° C. Particularly preferred preparation processes operate in the case of roll compaction at processing temperatures which are 10° C., in particular at most 5° C., above the melting temperature or the upper temperature limit of the melting range of the binder. In this connection, it is further preferred that the duration of the temperature effect in the compression zone of the smooth rolls or rolls provided with indentations of defined form is at most 2 minutes and is in particular in a range between 30 seconds and 1 minute.

The laundry detergent according to the invention can also be prepared by means of pelleting. Here, the premix is applied to a perforated surface and pressed through the holes by means of a pressure-exerting body with plastification. With customary variants of pelleting presses, the premix is compressed under pressure, plasticized, pressed through a perforated surface by means of a rotating roll in the form of fine strands and finally comminuted using a chopping device to give granulate particles.

In this connection, a very wide variety of configurations of pressure rolls and perforated dies are conceivable. Thus, for example, flat perforated plates are used, as are concave or convex annular dies through which the material is pressed by means of one or more pressure rolls. The pressure rolls can also be conical in shape in the case of the plate devices, and in the annular devices, dies and pressure roll(s) can be corotating or counterrotating. An apparatus suitable for carrying out the process is described, for example, in German laid-open specification DE 3816842 A1. The annular die press disclosed in this specification consists of a rotating annular die interspersed by pressure channels, and at least one pressure roll which cooperates with the inside surface of the annular die and which presses the material introduced into the inside of the die through the compression channels into a material discharge. Here, annular dies and compression rolls can be operated in the same direction, as a result of which it is possible to achieve reduced shear stress and therefore a lower temperature increase of the premix. However, it is also possible to use heatable or chillable rolls during the pelleting in order to establish a desired temperature of the premix. In the case of pelleting too, the temperature of the compression tools, i.e. of the compression rolls or pressure rolls, is preferably at most 150° C., preferably at most 100° C. and in particular at most 75° C. Particularly preferred preparation processes operate in the case of roll compaction at processing temperatures which are 10° C., in particular at most 5° C., above the melting temperature or the upper temperature limit of the melting range of the binder.

A further compression agglomeration process which can be used to prepare the laundry detergents according to the invention is tableting. Because of the size of the moldings prepared, in the case of tableting it may be useful to add, in addition to the binder described above, customary disintegration auxiliaries, for example cellulose and its derivatives, in particular in coarse form, or crosslinked PVP, which facilitate disintegration of the compacts in the wash liquor. The resulting particulate compression agglomerates can either be used directly as laundry detergents or are after-treated and/or worked up by customary methods beforehand. Customary after-treatments include, for example, powdering with finely divided ingredients of laundry detergents or cleaners, as a result of which the bulk weight is generally further increased. However, a preferred after-treatment is also the procedure according to German patent applications DE 19524287 A1 and DE 19547457 A1, where dust-like or at least finely divided ingredients (so-called fines) are adhered to the particulate process end-products prepared according to the invention, which serve as core, thus giving compositions which have these fines as external sheath. This in turn is advantageously carried out by melt agglomeration. For details of the melt agglomeration of the fines, reference is expressly made to the disclosure in German patent applications DE 19524287 A1 and DE 19547457 A1. In the preferred embodiment of the invention, the solid detergents are in tablet form, these tablets in particular having preferably rounded corners and edges for storage and transportation reasons. The basic area of these tablets can, for example, be circular or rectangular. Multilayer tablets, in particular tablets with 2 or 3 layers, which may also be of different colors, are primarily preferred. Blue-white or green-white or blue-green-white tablets are particularly preferred. Detergent tablets generally comprise a disintegrant which is intended to effect rapid dissolution of the tablet or the rapid disintegration of the tablet in the aqueous liquor. In this connection, reference is expressly made to the contents of the German patent applications DE 19709991 A1 and DE 19710254 A1 in which preferred cellulose-based disintegrant granules are described.

The solid detergents according to the invention are characterized by a reliably controlled foam behavior, including those laundry detergents with high proportions of nonionic surfactants which are particularly difficult to defoam. The foaming of the solid detergents can also be controlled without the addition of silicones, in most cases only by the addition of waxlike antifoams, which are considerably more cost-effective, primarily since they only have to be used in relatively small amounts. Without being tied to one theory, the presence of the linear nonionic surfactants of the formula (II) appears to be essential for this effect.

EXAMPLES

The powder laundry detergents were investigated with regard to the foaming behavior. For this purpose, 3.5 kg of standard laundry were washed in a Miele washing machine (Miele W 918) at a temperature of 90° C. in a complete washing cycle. 75 g of the test formulations in Table 1 were introduced into the detergent drawer directly prior to washing. The foam which formed during the washing operation was observed and measured every 10 minutes, and the maximum foam height was graded. The following grades were assigned:

0=no foam visible

1=foam fills ¼ of the porthole

2=foam fills ½ of the porthole

3=foam fills ¾ of the porthole

4=the entire porthole is filled with foam

5=foam in the inside of the dosing drawer

6=foam is visible in the dosing drawer

7=machine foams over

The results are summarized in Table 1. Examples 1 to 9 are in accordance with the invention, and Examples C1 to C4 serve for comparison.

TABLE 1

Foaming behavior of powder laundry detergents

| Composition | 1 | 2 | 3 | 4 | 5 | C1 | C2 |
|---|---|---|---|---|---|---|---|
| Alkyl glucoside, $C_{12/14}$-coconut alcohol basis | 8.0 | 8.0 | 8.0 | 8.0 | 8.0 | 8.0 | 8.0 |
| $C_{16/18}$-tallow alcohol + 7EO | 1.0 | 1.0 | 1.0 | 2.0 | 2.0 | — | — |
| $C_{12/14}$-coconut alcohol + 7EO | 6.0 | 6.0 | — | 5.0 | — | 7.0 | — |
| Lial ® 125 + 7EO[1] | — | — | 6.0 | — | 5.0 | — | 7.0 |
| Dodecylbenzene sulfonate, sodium salt | — | — | — | — | — | — | — |
| Sodium carbonate | 25.0 | 25.0 | 25.0 | 25.0 | 25.0 | 25.0 | 25.0 |
| Zeolite NaX | — | — | — | — | — | — | — |
| Tripolyphosphate | 25.0 | 25.0 | 25.0 | 25.0 | 25.0 | 25.0 | 25.0 |
| Sokalan CP5 | — | — | — | — | — | 0 | 0 |
| Antifoam[2] | 3.0 | 4.0 | 6.0 | 2.0 | 4.0 | 5.0 | 6.0 |
| Sodium sulfate | Ad 100 | Ad 100 | Ad 100 | Ad 100 | Ad 100 | Ad 100 | Ad 100 |
| Foam grade | 2 | 1 | 2 | 1 | 2 | 2 | 5 |

| Composition | 6 | 7 | 8 | 9 | C3 | C4 |
|---|---|---|---|---|---|---|
| Alkyl glucoside, $C_{12/14}$-coconut alcohol basis | 4.0 | 4.0 | 4.0 | 4.0 | 4.0 | 4.0 |
| $C_{16/18}$-tallow alcohol + 7EO | 2.0 | 2.0 | 6.0 | 6.0 | — | — |
| $C_{12/14}$-coconut alcohol + 7EO | 14.0 | — | 10.0 | — | 16.0 | — |
| Lial ® 125 + 7EO[1] | — | 14.0 | — | 10.0 | — | 16.0 |
| Dodecylbenzene sulfonate, sodium salt | — | — | — | — | — | — |
| Sodium carbonate | 25.0 | 25.0 | 25.0 | 25.0 | 25.0 | 25.0 |
| Zeolite NaX | 25.0 | 25.0 | 25.0 | 25.0 | 25.0 | 25.0 |
| Tripolyphosphate | — | — | — | — | — | — |
| Sokalan CP5 | 5.0 | 5.0 | 5.0 | 5.0 | 5.0 | 5.0 |
| Antifoam[2] | 4.0 | 6.0 | 3.0 | 4.0 | 6.0 | 6.0 |
| Sodium sulfate | Ad 100 | Ad 100 | Ad 100 | Ad 100 | Ad 100 | Ad 100 |
| Foam grade | 3 | 3 | 2 | 2 | 3 | 7 |

[1]Lial ® 125 is a $C_{11-15}$-alcohol mixture of 43.5% by weight of saturated linear alcohols, 15.5% by weight of methyl-branched alcohols and 41% by weight of alcohols branched with alkyl groups having at least 2 carbon atoms.

[2]10% by weight of silicone-paraffin wax mixture on 60% by weight of sodium carbonate and 30% by weight of sodium sulfate as carrier Table 1 shows that the examples according to the invention containing $C_{16/18}$-coconut alcohol+7EO and alkyl glucoside, both in the presence of linear alcohol ethoxylates, such as $C_{12/14}$-coconut alcohol+7EO (ex. 1, 2, 4 compared with C1), and also in the case of heavily branched alcohol ethoxylates (Ex. 3, 5 compared with C2) in phosphate-containing and also in zeolite-containing laundry detergents (Ex. 6, 8 compared with C3 or Ex. 7, 9 compared with C4), achieve similar or better foam grades where the amounts of antifoam are lower, and always achieve better foam grades for the same amounts of antifoam.

What is claimed is:

1. A solid laundry detergent comprising a surfactant mixture, wherein the surfactant mixture comprises:

(a) a nonionic surfactant mixture present in an amount greater than 60% by weight, based on the weight of the surfactant mixture, the nonionic surfactant mixture comprising:

(i) at least one alk(en)yl oligoglycoside of the general formula (I), $$R^1O—[G]_p \quad (I)$$

wherein $R^1$ represents an alk(en)yl radical having from 4 to 22 carbon atoms, G represents a sugar radical having 5 or 6 carbon atoms and p represents a number from 1 to 10; and (ii) at least one nonionic surfactant of the general formula (II)

$$R^2O(CH_2CHRO)_xH \quad (II)$$

wherein x represents a number of from 1 to 30, each R independently represents a substituent selected from the group consisting of a hydrogen, a methyl group and an ethyl group, and $R^2$ represents a linear alkyl radical having from 16 to 22 carbon atoms; and (b) up to 6% by weight, based on the weight of the surfactant mixture, of one or more anionic surfactants.

2. The surfactant mixture according to claim 1, wherein the nonionic surfactant mixture further comprises: (c) at least one additional nonionic surfactant selected from the group consisting of alkoxylates of an alcohol mixture according to the general formula (III), alkoxylates of an alcohol mixture according to the general formula (IV), alkoxylates of an alcohol mixture according to the general formula (V), and fatty acid polyglycol esters of the general formula (VI);

| | |
|---|---|
| $R^3O(CH_2CHRO)_yH$ | (III) |
| $R^4O(CH_2CHRO)_zH$ | (IV) |
| $R^5O(CH_2CHRO)_qH$ | (V) |
| $R^6COO(CH_2CHRO)_sR^7$ | (VI) |

wherein each of y, z, q and s independently represents a number of from 1 to 30, each R independently represents a substituent selected from the group consisting of a hydrogen, a methyl group and an ethyl group; $R^3$ represents an alkyl radical derived from an alcohol mixture comprising from 70 to 95% by weight of $C_{8-22}$ linear alcohols, from 5 to 30% by weight of $C_{8-22}$ alcohols branched with methyl groups, and up to 10% by weight of $C_{8-22}$ alcohols branched with alkyl groups having at least 2 carbon atoms; $R^4$ represents an alkyl radical derived from an alcohol mixture comprising from 35 to 55% by weight of $C_{8-22}$ linear alcohols, from 10 to 20% by weight of $C_{8-22}$ alcohols branched with methyl groups, and 35 to 45% by weight of $C_{8-22}$ alcohols branched with alkyl groups having at least 2 carbon atoms; $R^5$ represents an alkyl radical derived from an alcohol mixture comprising up to 10% by weight of $C_{6-10}$ linear alcohols, from 40 to 90% by weight of $C_{12-14}$ linear alcohols, and up to 30% by weight of $C_{16-22}$ linear alcohols; and wherein $R^6CO$ represents an acyl radical having from 6 to 22 carbon atoms and $R^7$ represents an alkyl radical having from 1 to 4 carbon atoms.

3. The surfactant mixture according to claim 1, wherein the at least one nonionic surfactant of the general formula (II) comprises an alkoxylated mixture of linear alcohols, the mixture of linear alcohols comprising from 80 to 100% by weight of alcohols having from 16 to 22 carbon atoms and from 0 to 20% by weight of alcohols having from 6 to 14 carbon atoms, the weight percents being based on the total weight of the mixture of alcohols.

4. The surfactant mixture according to claim 3, wherein the mixture of linear alcohols comprises from 3 to 8% by weight of linear saturated alcohols having 14 carbon atoms, from 25 to 35% by weight of linear saturated alcohols having 16 carbon atoms, and from 60 to 70% by weight of linear saturated alcohols having 18 carbon atoms.

5. The surfactant mixture according to claim 4, further comprising up to 2% by weight of linear saturated alcohols having 12 carbon atoms, and up to 2% by weight of linear saturated alcohols having 22 carbon atoms.

6. The surfactant mixture according to claim 1, wherein x represents a number of from 4 to 12 and each R represents hydrogen.

7. The surfactant mixture according to claim 1, wherein the nonionic surfactant mixture further comprises: (c) at least one additional nonionic surfactant selected from the group consisting of alkoxylates of an alcohol mixture according to the general formula (III):

$$R^3O(CH_2CHRO)_yH \quad \text{(III)}$$

wherein y represents a number of from 1 to 30, each R independently represents a substituent selected from the group consisting of a hydrogen, a methyl group and an ethyl group, and $R^3$ represents an alkyl radical derived from an alcohol mixture comprising from 73 to 85% by weight of $C_{8-22}$ linear alcohols, from 13 to 25% by weight of $C_{8-22}$ alcohols branched with methyl groups, and from 2 to 7% by weight of $C_{8-22}$ alcohols branched with alkyl groups having at least 2 carbon atoms.

8. The surfactant mixture according to claim 1, wherein the nonionic surfactant mixture further comprises: (c) at least one additional nonionic surfactant selected from the group consisting of alkoxylates of an alcohol mixture according to the general formula (III):

$$R^3O(CH_2CHRO)_yH \quad \text{(III)}$$

wherein y represents a number of from 1 to 30, each R independently represents a substituent selected from the group consisting of a hydrogen, a methyl group and an ethyl group, and $R^3$ represents an alkyl radical derived from an alcohol mixture comprising from 73 to 85% by weight of $C_{12-15}$ linear alcohols, from 13 to 25% by weight of $C_{12-15}$ alcohols branched with methyl groups, and from 2 to 7% by weight of $C_{10-15}$ alcohols branched with alkyl groups having at least 2 carbon atoms.

9. The surfactant mixture according to claim 1, wherein the nonionic surfactant mixture further comprises: (c) at least one additional nonionic surfactant selected from the group consisting of alkoxylates of an alcohol mixture according to the general formula (III):

$$R^3O(CH_2CHRO)_yH \quad \text{(III)}$$

wherein y represents a number of from 4 to 12, each R independently represents a substituent selected from the group consisting of a hydrogen, a methyl group and an ethyl group, and $R^3$ represents an alkyl radical derived from an alcohol mixture comprising from 70 to 95% by weight of $C_{8-22}$ linear alcohols, from 5 to 30% by weight of $C_{8-22}$ alcohols branched with methyl groups, and up to 10% by weight of $C_{8-22}$ alcohols branched with alkyl groups having at least 2 carbon atoms.

10. The surfactant mixture according to claim 1, wherein the nonionic surfactant mixture further comprises: (c) at least one additional nonionic surfactant selected from the group consisting of alkoxylates of an alcohol mixture according to the general formula (IV):

$$R^4O(CH_2CHRO)_zH \quad \text{(IV)}$$

where z represents a number of from 1 to 30, each R independently represents a substituent selected from the group consisting of a hydrogen, a methyl group and an ethyl group, and $R^4$ represents an alkyl radical derived from an alcohol mixture comprising from 50 to 60% by weight of branched alcohols, and from 40 to 50% by weight of linear alcohols.

11. The surfactant mixture according to claim 1, wherein the nonionic surfactant mixture further comprises: (c) at least one additional nonionic surfactant selected from the group consisting of alkoxylates of an alcohol mixture according to the general formula (IV):

$$R^4O(CH_2CHRO)_zH \quad \text{(IV)}$$

wherein z represents a number of from 4 to 12, each R represents hydrogen, and $R^4$ represents an alkyl radical derived from an alcohol mixture comprising from 50 to 60% by weight of branched alcohols, and from 40 to 50% by weight of linear alcohols.

12. The surfactant mixture according to claim 1, wherein the nonionic surfactant mixture further comprises: (c) at least one additional nonionic surfactant selected from the group consisting of alkoxylates of an alcohol mixture according to the general formula (V):

$$R^5O(CH_2CHRO)_qH \quad \text{(V)}$$

wherein q represents a number of from 1 to 30, each R independently represents a substituent selected from the group consisting of a hydrogen, a methyl group and an ethyl group, and $R^5$ represents an alkyl radical derived from an alcohol mixture comprising up to 5% by weight of $C_{6-10}$ linear alcohols, from 55 to 85% by weight of $C_{12-14}$ linear alcohols, and from 10 to 25% by weight of $C_{16-22}$ linear alcohols.

13. The surfactant mixture according to claim 1, wherein the nonionic surfactant mixture further comprises: (c) at least one additional nonionic surfactant selected from the group consisting of alkoxylates of an alcohol mixture according to the general formula (V):

$$R^5O(CH_2CHRO)_qH \quad (V)$$

wherein q represents a number of from 4 to 12, each R represents hydrogen, and $R^5$ represents an alkyl radical derived from an alcohol mixture comprising up to 10% by weight of $C_{6-10}$ linear alcohols, from 40 to 90% by weight of $C_{12-14}$ linear alcohols, and up to 30% by weight of $C_{16-22}$ linear alcohols.

14. The surfactant mixture according to claim 1, wherein the nonionic surfactant mixture further comprises: (c) a fatty acid polyglycol ester of the general formula (VI):

$$R^6COO(CH_2CHRO)_sR^7 \quad (VI)$$

wherein s represents a number of from 10 to 15, each R represents hydrogen, $R^6CO$ represents an acyl radical having from 16 to 18 carbon atoms and $R^7$ represents a methyl group.

15. The surfactant mixture according to claim 1, wherein the at least one alk(en)yl oligoglycoside of the general formula (I) and the at least one nonionic surfactant of the formula (II) are present in a weight ratio of from 20:1 to 1:20.

16. The surfactant mixture according to claim 2, wherein the at least one alk(en)yl oligoglycoside of the general formula (I) and the combined at least one nonionic surfactant of the formula (II) and at least one additional nonionic surfactant are present in a weight ratio (a):(b)+(c) of from 10:1 to 1:20.

17. A solid laundry detergent comprising from 5 to 30% by weight, based on the weight of the detergent, of a surfactant mixture, wherein the surfactant mixture comprises:

(a) a nonionic surfactant mixture present in an amount greater than 60% by weight, based on the weight of the surfactant mixture, the nonionic surfactant mixture comprising:

(i) at least one alk(en)yl oligoglycoside of the general formula (I), $$R^1O—[G]_p \quad (I)$$

wherein $R^1$ represents an alk(en)yl radical having from 4 to 22 carbon atoms, G represents a sugar radical having 5 or 6 carbon atoms and p represents a number from 1 to 10; and (ii) at least one nonionic surfactant of the general formula (II)

$$R^2O(CH_2CHRO)_xH \quad (II)$$

wherein x represents a number of from 1 to 30, each R independently represents a substituent selected from the group consisting of a hydrogen, a methyl group and an ethyl group, and $R^2$ represents a linear alkyl radical having from 16 to 22 carbon atoms; and (b) up to 6% by weight, based on the weight of the surfactant mixture, of one or more anionic surfactants.

18. The solid laundry detergent according to claim 17, wherein the nonionic surfactant mixture further comprises: (c) at least one additional nonionic surfactant selected from the group consisting of alkoxylates of an alcohol mixture according to the general formula (III), alkoxylates of an alcohol mixture according to the general formula (IV), alkoxylates of an alcohol mixture according to the general formula (V), and fatty acid polyglycol esters of the general formula (VI);

| | |
|---|---|
| $R^3O(CH_2CHRO)_yH$ | (III) |
| $R^4O(CH_2CHRO)_zH$ | (IV) |
| $R^5O(CH_2CHRO)_qH$ | (V) |
| $R^6COO(CH_2CHRO)_gR^7$ | (VI) |

wherein each of y, z, q and s independently represents a number of from 1 to 30, each R independently represents a substituent selected from the group consisting of a hydrogen, a methyl group and an ethyl group; $R^3$ represents an alkyl radical derived from an alcohol mixture comprising from 70 to 95% by weight of $C_{8-22}$ linear alcohols, from 5 to 30% by weight of $C_{8-22}$ alcohols branched with methyl groups, and up to 10% by weight of $C_{8-22}$ alcohols branched with alkyl groups having at least 2 carbon atoms; $R^4$ represents an alkyl radical derived from an alcohol mixture comprising from 35 to 55% by weight of $C_{8-22}$ linear alcohols, from 10 to 20% by weight of $C_{8-22}$ alcohols branched with methyl groups, and 35 to 45% by weight of $C_{8-22}$ alcohols branched with alkyl groups having at least 2 carbon atoms; $R^5$ represents an alkyl radical derived from an alcohol mixture comprising up to 10% by weight of $C_{6-10}$ linear alcohols, from 40 to 90% by weight of $C_{12-14}$ linear alcohols, and up to 30% by weight of $C_{16-22}$ linear alcohols; and wherein $R^6CO$ represents an acyl radical having from 6 to 22 carbon atoms and $R^7$ represents an alkyl radical having from 1 to 4 carbon atoms.

19. The solid laundry detergent according to claim 17, wherein the at least one nonionic surfactant of the general formula (II) comprises an alkoxylated mixture of linear alcohols, the mixture of linear alcohols comprising from 80 to 100% by weight of alcohols having from 16 to 22 carbon atoms and from 0 to 20% by weight of alcohols having from 6 to 14 carbon atoms, the weight percents being based on the total weight of the mixture of alcohols.

20. The solid laundry detergent according to claim 19, wherein the mixture of linear alcohols comprises from 3 to 8% by weight of linear saturated alcohols having 14 carbon atoms, from 25 to 35% by weight of linear saturated alcohols having 16 carbon atoms, and from 60 to 70% by weight of linear saturated alcohols having 18 carbon atoms.

21. The solid laundry detergent according to claim 17,further comprising up to 2% by weight of linear saturated alcohols having 12 carbon atoms, and up to 2% by weight of linear saturated alcohols having 22 carbon atoms.

22. The solid laundry detergent according to claim 17, wherein x represents a number of from 4 to 12 and each R represents hydrogen.

23. The solid laundry detergent according to claim 17, further comprising an antifoam, the antifoam being present in an amount of from about 0.05 to 5% by weight, calculated as active substance content based on the detergent.

24. A method of preparing a foam-controlled, solid laundry detergent, said method comprising: providing a surfactant mixture; providing one or more solid laundry detergent composition formulating auxiliaries; and combining the surfactant mixture and the one or more auxiliaries; wherein the surfactant mixture comprises (a) a nonionic surfactant mixture present in an amount greater than 60% by weight, based on the weight of the surfactant mixture, the nonionic surfactant mixture comprising:

(i) at least one alk(en)yl oligoglycoside of the general formula (I), $$R^1O—[G]_p \quad (I)$$

wherein $R^1$ represents an alk(en)yl radical having from 4 to 22 carbon atoms, G represents a sugar radical having 5 or 6 carbon atoms and p represents a number from 1 to 10; and (ii) at least one nonionic surfactant of the general formula (II)

$$R^2O(CH_2CHRO)_xH \quad (II)$$

wherein x represents a number of from 1 to 30, each R independently represents a substituent selected from the group consisting of a hydrogen, a methyl group and an ethyl group, and $R^2$ represents a linear alkyl radical having from 16 to 22 carbon atoms; and (b) up to 6% by weight, based on the weight of the surfactant mixture, of one or more anionic surfactants.

* * * * *